United States Patent [19]

Auer

[11] Patent Number: 4,461,664

[45] Date of Patent: Jul. 24, 1984

[54] MANUFACTURING FIBERBOARD DUCTS

[76] Inventor: Mark J. Auer, 23520 Lake Rd., Bay Village, Ohio 44140

[21] Appl. No.: 428,147

[22] Filed: Sep. 29, 1982

[51] Int. Cl.[3] ..... B31F 23/10

[52] U.S. Cl. ..... 156/204; 156/64; 156/468; 156/498; 226/196; 229/16 R; 493/52; 493/78; 493/179

[58] Field of Search ..... 156/64, 204, 378, 468, 156/498; 229/16 R; 226/196; 493/52, 73, 78, 179, 182

[56] References Cited

U.S. PATENT DOCUMENTS

| | | | |
|---|---|---|---|
| 3,242,780 | 3/1966 | Ried et al. . | |
| 3,420,142 | 1/1969 | Gale et al. . | |
| 3,534,646 | 10/1970 | Tyer . | |
| 3,605,534 | 9/1971 | Barr . | |
| 3,829,338 | 8/1974 | Hayasi et al. | 156/64 |
| 3,850,775 | 11/1974 | Bruneau et al. | 156/468 |
| 3,908,526 | 9/1975 | Vas Salos | 493/297 |
| 4,045,263 | 8/1977 | Moore et al. | 156/64 |
| 4,070,954 | 1/1978 | Cailey | 493/287 |
| 4,337,113 | 6/1982 | Searle | 156/498 |

*Primary Examiner*—Edward C. Kimlin
*Assistant Examiner*—Timothy W. Heitbrink
*Attorney, Agent, or Firm*—Thomas M. Schmitz

[57] ABSTRACT

The apparatus forms fiberboard hollow ducts from fiberboard and comprises means for collapsing the fiberboard into a flat collapsed fiberboard means for advancing the collapsed fiberboard through a preheating and heating stage while heat sensitive tape is applied to the linear seam of the collapsed fiberboard. After tape is applied, means for applying pressure and cooling operate to permanently set the tape.

6 Claims, 11 Drawing Figures

MANUFACTURING FIBERBOARD DUCTS

BACKGROUND OF THE INVENTION

This invention pertains to the manufacture of fiberboard ducts for use as insulating conduit for transmitting hot or cold gases, and more particularly to an apparatus and method of forming flat fiberboard into individual hollow duct units.

Linear fiberboard duct is produced from a wide variety of fibrous boards which are formed into hollow duct units having a square or rectangular through-put cross-section. Several duct units are secured end to end to provide a continuous run of duct work such as shown in U.S. Pat. Nos. 3,242,780; 3,420,142; 3,534,646; and 3,605,534. Duct forming apparatus shown in these patents as well as in U.S. Pat. No. 4,070,954 comprise flat fiberboard folded into a rectangular cross section while passing through a plurality of elongated rollers arranged in an off-set parallelogram. The fiberboard is formed into a hollow duct whereby the duct seam is closed and secured with tape. The cross section of the duct can be changed by adjusting the elongated rollers inwardly or outwardly to accommodate larger or smaller cross-sectional duct units. Similarly, U.S. Pat. No. 3,908,526 suggests the formation of fiberboard tubes by coacting pairs of rollers adapted to maintain a hollow tube during the forming process. The prior art processes, however, require exact spacing of the peripheral rollers to maintain the fiberboard in the form of a parallelogram while securing the linear seam of the hollow duct. Thus, prior art processes necessitate maintaining the fiberboard in perfect parallelogram alignment during the formation of each hollow duct unit.

It now has been found that hollow fiberboard duct can be manufactured by folding the fiberboard flat with an upwardly exposed linear seam between the distal ends of the fiberboard, whereby the linear seam engages a depending permanent guide means adapted to maintain the adjacent wall members in butting position while the seam is permanently secured with tape. The centrally disposed permanent guide means avoids adjustments for different cross-sectional ducts and avoids maintaining hollow parallelogram alignment during the forming process. In accordance with the invention, flattened fiberboard is conveyed while the linear abutting edges of the fiberboard duct engages the guide means, which quickly and automatically aligns the adjacently disposed fiberboard wall members into butting position and is maintained in juxtaposition while the linear seam is stapled and sealed. Upon completely securing the linear seam, the flattened duct can be removed and stacked for shipping or expanded for use as hollow duct. The centrally disposed guide means permits accommodations of various size fiberboards without cumbersome adjustments to accommodate variable size cross sections, and further avoids the need for accurate adjustment of pairs of rollers to maintain proper parallelogram alignment. These and other advantages will become more apparent by referring to the drawings and the detailed description of the invention.

SUMMARY OF THE INVENTION

Briefly, the apparatus of this invention comprises means for forming fiberboard duct from grooved fiberboard containing grooved sections comprising two intermediate center sections and two outer end sections. The grooved fiberboard is conveyed to the apparatus in a flattened condition where the two outer end sections are collapsed downwardly onto the intermediate sections and the distal linear edges engage a centrally disposed linear guide means. The guide means functions to align and maintain in alignment any size fiberboard by aligning the distal linear edges of outer end sections to form a linear seam connection for the subsequent step of securing the adjacently disposed linear edges and provide a secured seam between opposed outer linear edges of the two outer fiberboard sections. The centrally disposed guide means maintains the collapsed fiberboard sections in close abutment and properly aligned while the collapsed fiberboard enters the linear seam securing step wherein the seam is taped or otherwise permanently secured. Upon emerging from the apparatus, the collapsed duct can be expanded to form a finished hollow fiberboard duct unit.

IN THE DRAWINGS

DETAILED DESCRIPTION OF THE INVENTION

Figure 1:
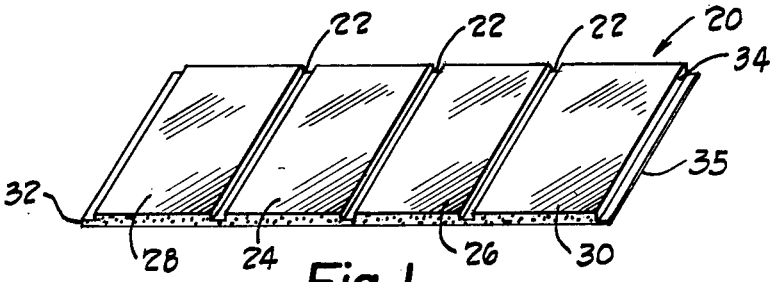
FIG. 1 is a perspective view of a length of grooved fiberboard prior to fabrication into a linear duct.
Figure 2:
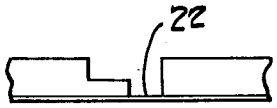
FIG. 2 is an enlarged end view of one one of the grooves in the fiberboard shown in FIG. 1.
Figure 3:
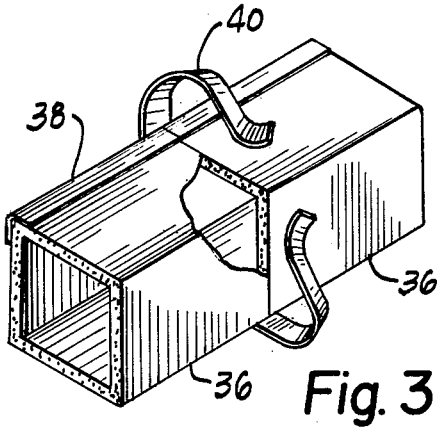
FIG. 3 is a perspective view of fiberboard ducts formed from grooved fiberboards in FIG. 1 and secured together to form linear duct work.

Referring to the drawing wherein like characters designate like parts, shown in FIG. 1 is a grooved fiberboard 20 containing three linear grooves 22 separating two intermediate or interior sections 24,26 from outer end sections 28,30 having distal outer edges 32,34. FIG. 2 shows an enlarged side elevation view of one of the linear grooves 22. FIG. 3 shows the fiberboard 20 folded inwardly at the grooves 22 to form two finished hollow duct units 36 having distal linear edges 32,34 secured with structural tape 38, whereby the two duct units 36 can be secured together end to end by peripherally applied structural tape 40 to form duct work. The fiberboad material can be any fibrous board and desirably includes impervious facing material on the outside surface and sometimes on both inner and outer surfaces such as Owen Corning "Fiberglas" duct board. The facing material can be aluminum foil or hard plastic sheeting such as vinyl plastic material.

Figure 5:
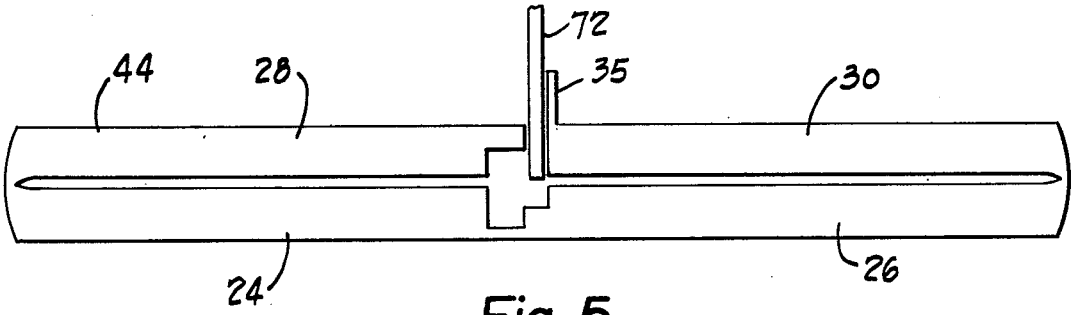
FIG. 5 shows an end view of the collapsed fiberboard engaging the overhead guide means shown in FIG. 4.
Figure 6:
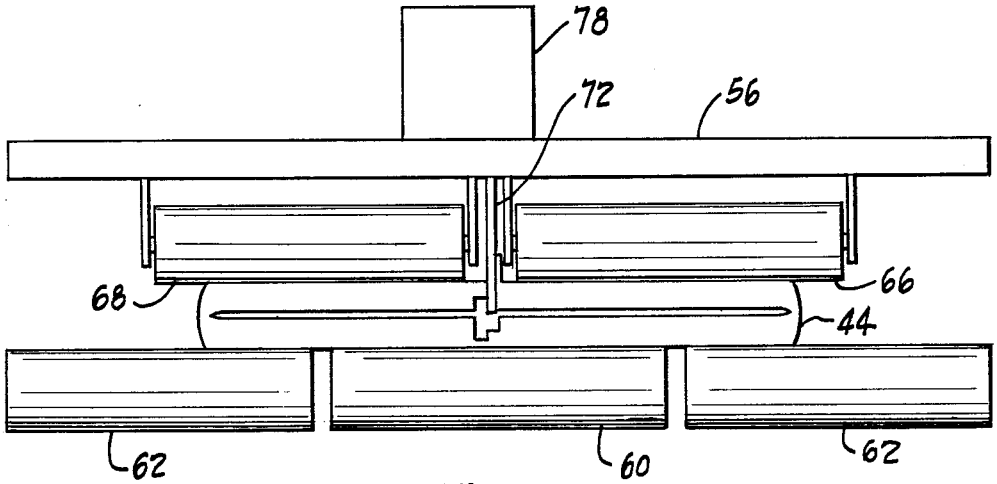
FIG. 6 is a sectional view taken along lines 6—6 in FIG. 4.
Figure 4:
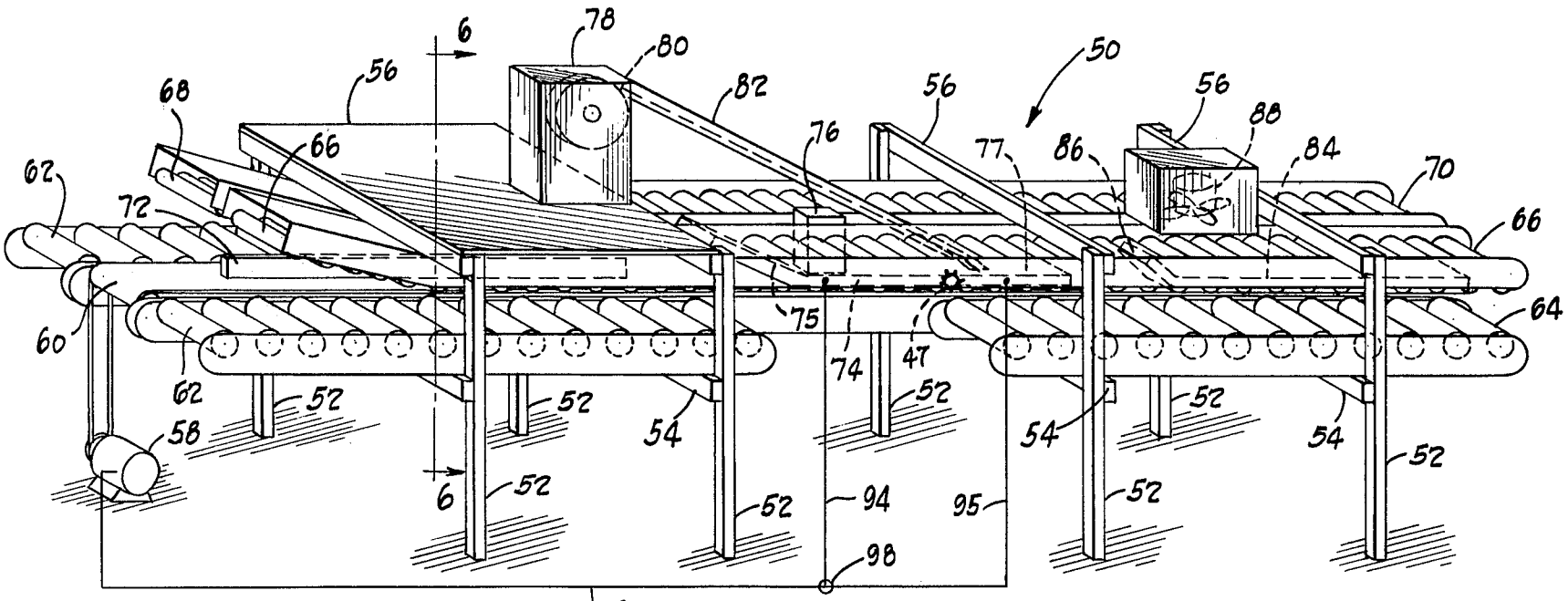
FIG. 4 is a perspective view of the apparatus of this invention adapted to convey folded fiberboard of FIG. 1 collapsed together to engage a guide means while the linear seam of the fiberboard is secured in accordance with this invention.
Figure 7:
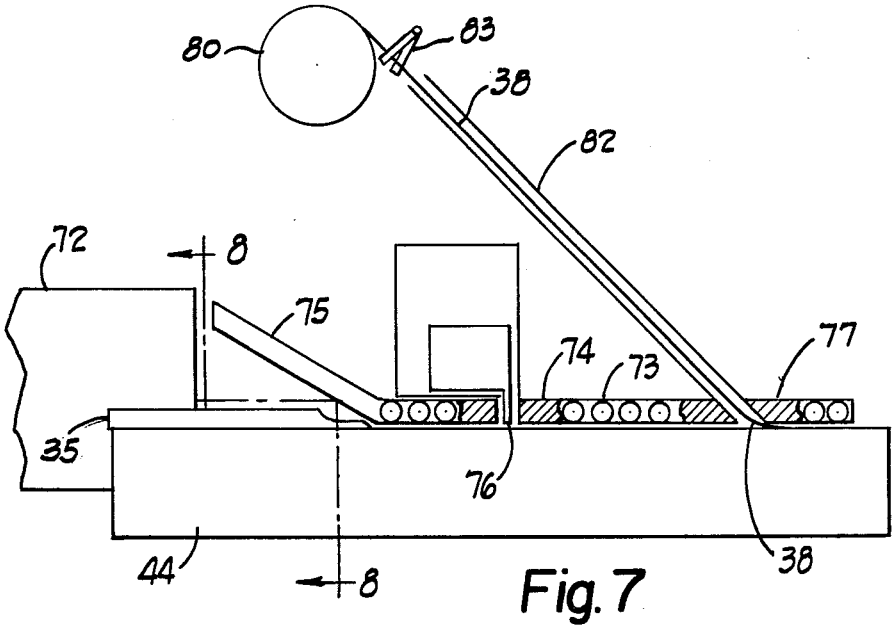
FIG. 7 is a partial side view of the apparatus in FIG. 4 particularly showing the collapsed fiberboard entering stapling and taping steps to secure the linear seam of the collapsed duct.
Figure 8:
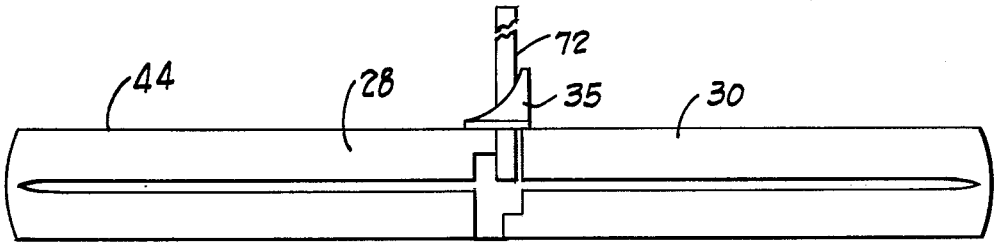
FIG. 8 is a partial sectional view taken along lines 8—8 in FIG. 7.
Figure 9:
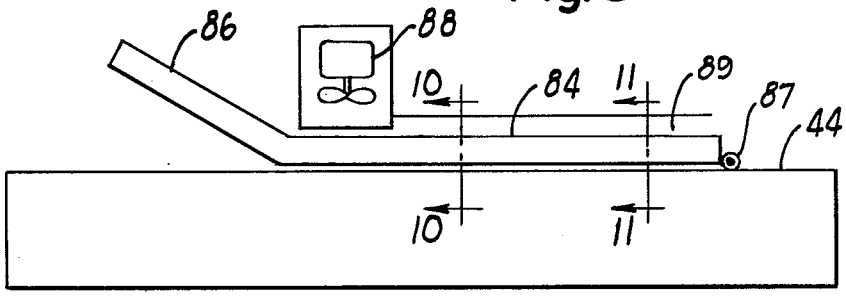
FIG. 9 is a partial side view of the apparatus in FIG. 4 particularly showing the collapsed fiberboard entering an ironing and cooling step after emerging from the taping step.

Referring next to FIG. 4, shown generally is an apparatus 50 adapted to secure linear structural tape 38 onto folded fiberboards 20 in accordance with this invention. The various parts of apparatus 50 are supported by structural steel framework comprising vertical posts or legs 52, lower horizontal frame members 54, and overhead frame members 56. A lower conveyor means is operatively supported upon the lower horizontal frame 54 and preferably comprises a steel wire central drive belt conveyor 60 along with a pair of side free wheeling skate roller conveyors 62 on either side of belt conveyor 60. The central drive conveyor 60 is operated by motor drive means 58 and extends the length of the apparatus 50, whereas the free wheeling side conveyors can be either a single conveyor or include rearward conveyor 62 and forward conveyor 64. Supported by the upper frame 56 is an upper conveyance means comprising a continuous upper roller conveyor 66 on one side and spaced laterally from an upper rearward roller conveyor 68 and upper forward conveyor 70 on the other side. The rearward portion of conveyors 66 and 68 are angled upwardly to assist in collapsing the fiberboard 20 upon entering the apparatus 50. The collapsed fiberboard 44 is shown in FIG. 5 wherein end sections 28,30 are bent inwardly and downwardly on top of interior sections 24,26.

In accordance with this invention, a depending overhead linear guide means 72 secured to upper frame 56 is disposed between upper conveyor 66 and rearward upper conveyor 68, whereby the linear guide means 72 is adapted to engage the linear distal edges 32,34 when the fiberboard 20 is collapsed together flat to form the collapsed fiberboard 44. Fiberboard 20 further includes a securing flap 35 extending from distal end 34 whereby the flap 35 is directed vertically upward while the collapsed fiberboard 44 engages the guide means 72. The elongated guide means 72 terminates linearly short of and spaced from an elongated horizontally disposed heating means 77 secured to overhead frame 56. The heating means 77 having a rearwardly disposed upwardly directed extension member 75 adapted to force the upwardly disposed flap 35 downwardly into flat engagement with adjacent fiberboard end section 28. The flap 35 remains extended upwardly while passing the guide means 72 but is forced flat upon engaging the upward directed member 75 and then becomes heated by the heating iron means 77 containing heating elements 73. The heating means 77 preferably comprises a preheat portion 74 linearly adjacent to member 75 for preheating the flap 35. The primary heating portion 77 provides post heating of tape 38 applied to the collapsed fiberboard 44. The flap 35 overlaps fiberboard end section 28 and is secured thereto by a stapling means 76 secured to overhead frame 56 and operative to secure staples into flap 35 and end section 28 through an opening in the heating means 74, whereby the fiberboard distal edges 32,34 are secured together in a laterally spaced relationship while still being guided by the guide means 72. Thus, the flap 35 is secured while being preheated prior to engaging structural tape 38 being dispensed from an overhead tape disperser 78 supported on top of the overhead frame 56. The structural tape 38 is heat sensitive tape and adapted to preferably thermoset upon heat curing by heating means 77 which preferably is tilted slightly downward terminating forward end to assure combined pressing and heating of the tape 38. Both the preheater 77 and the primary heater 74 contain heat sensing means 94 and 95 respectively interconnected to electrical relay switch 98 adapted to interrupt and stop the drive motor 58 in the event the preheater 74 or the primary heater 77 malfunctions by overheating or by losing heat. Surface temperature of the primary heater is typically about 400° F. and sufficient to cure the heat sensitive tape 38. The tape 38 is activated by roller switch means 47 adapted to activate tape 38 and dispense from a tape roll 80 through a downwardly depending track 82 extending through the heat means 77 to engage the preheated top surface of flap 35, whereby tape 38 secures flap 35 and adjacent fiberboard end section 28. The track 82 preferably is an insulated track. A cutting means 83 by the tape dispenser 78 is operative to precut the tape 38 to predetermined lengths to be applied to the collapsed fiberboard 44.

Figure 10:
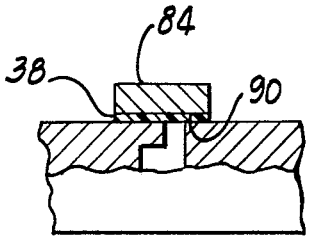
FIG. 10 is a partial sectional view taken along lines 10—10 in FIG. 9.
Figure 11:
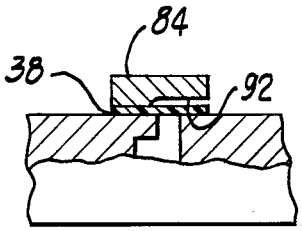
FIG. 11 is a partial sectional view taken along lines 11—11 in FIG. 9.

The heating means 77 terminates linearly short of a forwardly disposed horizontal cooling shoe 84 having a rearward upward bevel 86. The cooling shoe 84 is supported by overhead frame 56 and can contain an external cooling frame 88 disposed above the cooling shoe 84 and secured to the overhead frame 56 and preferably is interconnected to a cooling tunnel 89 disposed above shoe 84. The cooling shoe 84 functions to withdraw heat from the tape 38 thereby permanently setting the adhesive and securing the adjacently disposed fiberboard end sections 28,30. As shown in FIGS. 10 and 11, the cooling shoe 84 contains a generally flat bottom surface 90 at the intermediate portion of cooling shoe 84 and a contoured uneven bottom surface 92 on one side as viewed in FIG. 11 which assures prefentially applied pressure overall the tape 38. In like manner, the heating means 77 can include a heating surface comprising a flat surface and an uneven contoured surface as illustrated in FIGS. 10 and 11. The termination point of cooling means 84 includes a pair of wheels 87 on the cooling shoe 84. Upon emerging from the apparatus 50, the collapsed fiberboard 44 can be expanded to form a finished hollow duct 36 as shown in FIG. 3.

In accordance with the process of this invention, grooved fiberboard 20 is folded inwardly whereby the end sections 28,30 are folded downwardly onto the intermediate sections 24,26 whereupon the folded fiberboard 44 is conveyed forwadly into the apparatus 50. The folded fiberboard 44 first engages the upwardly angled portions of the upper roller conveyor 66,68 whereby the folded fiberboard 44 is collapsed tightly against the lower conveyors 60,62 upon entering the apparatus 50. The collapsed fiberboard 44 has distal edges 32,34 spaced laterally apart to engage either side of the depending guide means 72 which aligns the collapsed fiberboard 44 and maintains the distal edges 32,34 essentially parallel during the process for securing the fiberboard flap 35 to the upper surface of end section 28. The flap 35 is first extended upwardly by the guide means 72 until the collapsed board 44 engages the rearwardly disposed upwardly directed extension member 75 of the heating means 77 which forces the flap 35 downward to rest flat against the upper surface of the end section 28. The forward moving collapsed fiberboard 44 causes the flattened flap 35 to engage the upper surface of the preheat portion 74 of heating means 77, where the flap can be stapled if desired while being preheated, and then engages heat sensitive tape 38 being dispensed through an opening within the heating means 77. The forward end portion of the heating means 74 applies pressure to the applied tape 35 causing a secure bond between the tape 38 and the flap 35 as well as the adjacent top surface of the opposed edge 32 of fiberboard end section 28. Thereafter, the collapsed fiberboard 44 enter the cooling zone where the cooling shoe 84 further applies pressure and cools the tape 38 to permanently set the adhesive and secure the linear seam of the collapsed fiberboard duct 44. The collapsed fiberboard 44 emerges forwardly from the exit end of the apparatus 50 in a collapsed condition which can be either stored as a collapsed fiberboard 44 or expanded to form a hollow duct 36.

The apparatus of this invention provides a very efficient method of securing the linear seam on fiberboard duct by utilizing a permanently secured overhead guide means whereby various size ducts can be easily fabricated without carefully controlled adjustments. Fiberboard is easily collapsed and conveyed forwardly in abutting engagement with the guide means which maintains parallel alignment of juxtapositioned edges during the process for securing the linear seam.

Although the foregoing illustrates preferred embodiments of this invention, variations are contemplated, and the foregoing is not intended to be limiting except by the appended claims.

I claim:

1. In a process for fabricating a flat fiberboard duct from a flat fiberboard comprising a plurality of linear sections, said linear sections comprising two intermediate sections and two outer end sections which terminate laterally with linear edges adapted to be secured together to form a linear seam, the first outer end section having a linear flap adjacent to the first outer end section linear edge and adapted to overlap the linear seam and be secured to the second outer end section adjacent to the second outer end section linear edge to form a folded fiberboard duct, the process steps comprising:

folding the fiberboard wherein the outer end sections fold onto the intermediate sections to provide a folded fiberboard duct having the distal linear edges of the outer end sections adjacently disposed to form a linear seam;

advancing the folded fiberboard duct and aligning the seam of the fiberboard duct with a centrally disposed linear guide means where each distal linear edge of the outer end sections engage the linear guide means to maintain the folded fiberboard duct in square alignment with the linear guide means;

collapsing the folded fiberboard duct between converging conveying means to form a flat fiberboard duct while maintaining the flat fiberboard duct in alignment with said linear guide means;

preheating the seam of the flat fiberboard duct while maintaining alignment with said linear guide means;

applying heat sensitive tape to the seam of said flat fiberboard duct while maintaining alignment with said linear guide means;

heating and pressing the heat sensitive tape to secure the tape whereby the tape secures the fiberboard flap to the second outer end section;

cooling the heated tape to set the tape while removing the flat fiberboard duct.

2. The process in claim 1 wherein the seam is stapled prior to the step of applying the heat sensitive tape to the seam of the flat fiberboard duct.

3. The process in claim 1 where the cooling step includes applied pressure to the tape.

4. The process in claim 3 wherein the pressure is applied by a contoured surface whereby alternate pressure in unevenly applied on alternate sides of the linear applied tape.

5. The process in claim 1 where the preheating step is preceeded by flattening the flap onto the second outer end section of the flat fiberboard duct.

6. The process in claim 1 wherein means are provided for sensing the temperatures in the preheating step and heating step whereby the temperature sensing means is operative to stop the advancing of the flat fiberboard duct in the event of overheat or loss of heat in either the preheating step or heating step.

* * * * *